US011114075B2

(12) United States Patent
Ohta et al.

(10) Patent No.: US 11,114,075 B2
(45) Date of Patent: Sep. 7, 2021

(54) ELECTRONIC MUSICAL INSTRUMENT AND ELECTRONIC MUSICAL INSTRUMENT SYSTEM

(71) Applicant: Yamaha Corporation, Hamamatsu (JP)

(72) Inventors: Shinichi Ohta, Hamamatsu (JP); Kevin Macmanus, Chiswick (GB)

(73) Assignee: Yamaha Corporation, Hamamatsu (JP)

( * ) Notice: Subject to any disclaimer, the term of this patent is extended or adjusted under 35 U.S.C. 154(b) by 167 days.

(21) Appl. No.: 16/456,186

(22) Filed: Jun. 28, 2019

(65) Prior Publication Data

US 2019/0318714 A1 Oct. 17, 2019

Related U.S. Application Data

(63) Continuation of application No. PCT/JP2017/046659, filed on Dec. 26, 2017.

(30) Foreign Application Priority Data

Dec. 29, 2016 (JP) ..... JP2016-257337

(51) Int. Cl.
*G10H 1/34* (2006.01)
*G10H 1/08* (2006.01)
*G10H 1/18* (2006.01)

(52) U.S. Cl.
CPC ..... *G10H 1/34* (2013.01); *G10H 1/08* (2013.01); *G10H 1/18* (2013.01)

(58) Field of Classification Search
CPC ..... G10H 1/34; G10H 1/08; G10H 1/18
See application file for complete search history.

(56) References Cited

U.S. PATENT DOCUMENTS 8,476,517 B2 * 7/2013 Humphrey ..... G09B 15/00 84/470 R
2006/0054004 A1 3/2006 Funaki
2010/0083814 A1 * 4/2010 Kira ..... G10H 1/24 84/622

FOREIGN PATENT DOCUMENTS

JP 6-83338 A 3/1994
JP 7-152370 A 6/1995
(Continued)

OTHER PUBLICATIONS

International Search Report (PCT/ISA/210) issued in PCT Application No. PCT/JP2017/046659 dated Mar. 13, 2018 with English translation (four (4) pages).
(Continued)

*Primary Examiner* — Jianchun Qin
(74) *Attorney, Agent, or Firm* — Crowell & Moring LLP

(57) ABSTRACT

Provided is an electronic musical instrument. The electronic musical instrument is configured to generate an internal acoustic signal; generate a sound generation instruction signal; output the sound generation instruction signal to an external sound source configured to generate an external acoustic signal; switch a first state in which the external acoustic signal is generated by the external sound source in response to the sound generation instruction signal, to a second state in which the internal acoustic signal is generated in response to the sound generation instruction signal; and, when the first state is switched to the second state, set a mode of the internal acoustic signal such that the internal acoustic signal is generated with a mode having a predetermined degree of similarity to a mode of the external acoustic signal generated in the first state.

19 Claims, 9 Drawing Sheets

(56) References Cited

FOREIGN PATENT DOCUMENTS

| | | | |
|---|---|---|---|
| JP | 2003-348682 | A | 12/2003 |
| JP | 2005-203040 | A | 7/2005 |
| JP | 2010-231053 | A | 10/2010 |

OTHER PUBLICATIONS

Japanese-language Written Opinion (PCT/ISA/237) issued in PCT Application No. PCT/JP2017/046659 dated Mar. 13, 2018 (five (5) pages).
Japanese-language Office Action issued in counterpart Japanese Application No. 2016-257337 dated Nov. 11, 2019 with English translation (five (5) pages).
German-language Office Action issued in German Application No. 11 2017 006 691.3 dated Jun. 21, 2021 with partial English translation (six (6) pages).

* cited by examiner

Fig.2B

T2

| | Timbre | External sound source 20b | Internal sound source |
|---|---|---|---|
| | | Piano a2 | Piano A |
| | | Piano b2 | Piano B |
| | | Piano c2 | Piano C |
| | | Guitar a2 | Guitar A |
| | | Guitar b2 | Guitar B |
| | | Guitar c2 | Guitar C |
| | | Bass a2 | Bass A |
| | | Bass b2 | Bass B |
| | | Bass c2 | Bass C |
| | | ⋮ | ⋮ |

Fig.2A

T1

| | Timbre | External sound source 20a | Internal sound source |
|---|---|---|---|
| | | Piano a1 | Piano A |
| | | Piano b1 | Piano B |
| | | Piano c1 | Piano C |
| | | Guitar a1 | Guitar A |
| | | Guitar b1 | Guitar B |
| | | Guitar c1 | Guitar C |
| | | Bass a1 | Bass A |
| | | Bass b1 | Bass B |
| | | Bass c1 | Bass C |
| | | ⋮ | ⋮ |

Fig.3B

C2

| Timbre | Main category | Sub-category |
|---|---|---|
| | Piano | Piano a |
| | | Piano b |
| | | Piano c |
| | | Piano d |
| | Guitar | Guitar a |
| | | Guitar b |
| | | Guitar c |
| | | Guitar d |
| | Bass | Bass a |
| | | Bass b |
| | | Bass c |
| | | Bass d |
| | ・・・ | ・・・ |

Fig.3A

C1

| Timbre | Main category | Sub-category |
|---|---|---|
| | Piano | Piano A |
| | | Piano B |
| | | Piano C |
| | Guitar | Guitar A |
| | | Guitar B |
| | | Guitar C |
| | Bass | Bass A |
| | | Bass B |
| | | Bass C |
| | ・・・ | ・・・ |

ELECTRONIC MUSICAL INSTRUMENT AND ELECTRONIC MUSICAL INSTRUMENT SYSTEM

CROSS REFERENCE TO RELATED APPLICATIONS

The present application is a continuation application of International Application No. PCT/JP2017/046659, filed Dec. 26, 2017, which claims a priority to Japanese Patent Application No. 2016-257337, filed Dec. 29, 2016. The contents of these applications are incorporated herein by reference in their entirety.

FIELD OF INVENTION

The present invention relates to an electronic musical instrument that can connect to an external sound source and an electronic musical instrument system including the electronic musical instrument and the external sound source.

BACKGROUND

There are various electronic musical instruments that can connect to an external sound source. For example, in a performance assistance system according to JP 2010-231053A (hereinafter referred to as "Patent Document 1"), an electronic musical instrument is connected to a chord information generation apparatus via a performance assistance apparatus. The electronic musical instrument, the chord information generation apparatus, and the performance assistance apparatus each include a sound source/effect circuit. When the chord information generation apparatus and the performance assistance apparatus are connected through wireless communication, a performance assistance function is enabled, and a local OFF command is automatically transmitted to the electronic musical instrument. In this case, performance information from a performance operator of the electronic musical instrument is not directly supplied to the sound source/effect circuit (musical tone generation unit) of the electronic musical instrument.

Based on a set conversion property, the performance assistance apparatus converts a pitch of note information received from the electronic musical instrument into a pitch that fits the chord information received from the chord information generation apparatus, and the performance assistance apparatus transmits the converted note information to the electronic musical instrument. On the other hand, when the wireless communication between the chord information generation apparatus and the performance assistance apparatus is disconnected or the performance assistance function is turned off, a local ON command is automatically transmitted to the electronic musical instrument. The performance information from the performance operator of the electronic musical instrument is supplied to the sound source/effect circuit (musical tone generation unit) of the electronic musical instrument.

SUMMARY of INVENTION

In the performance assistance system according to Patent Document 1, the sound source/effect circuit of the chord information generation apparatus or the performance assistance apparatus can also be used as the external sound source of the electronic musical instrument. For example, performance information resulting from operation of a performance operator of the electronic musical instrument can be supplied to the external sound source, and a musical tone obtained based on an acoustic signal obtained from the external sound source can be generated from the electronic musical instrument.

However, if the electronic musical instrument and the external sound source are disconnected, or if a defect occurs in the external sound source, the acoustic signal will no longer be supplied normally from the external sound source to the electronic musical instrument. In this kind of case, it is desirable that sound generation is continued while suppressing a sense of incongruity felt by the user.

An object of the present invention is to provide an electronic musical instrument and an electronic musical instrument system that can continue sound generation while suppressing a sense of incongruity felt by a user when a failure occurs in an acoustic signal supplied from an external sound source.

An electronic musical instrument according to an embodiment of the present invention includes: an internal sound source configured to generate an internal acoustic signal; a generation means for generating a sound generation instruction signal; an output means that is connected to an external sound source configured to generate an external acoustic signal, and is for outputting the sound generation instruction signal to the external sound source; a switching means for switching a first state in which the external acoustic signal is generated by the external sound source in response to the sound generation instruction signal to a second state in which the internal acoustic signal is generated by the internal sound source in response to the sound generation instruction signal; and a setting means for, when the first state is switched to the second state, setting a mode of the internal acoustic signal such that the internal acoustic signal is generated with a mode similar to a mode of the external acoustic signal generated in the first state.

In this electronic musical instrument, if a failure occurs in the external acoustic signal supplied from the external sound source in the first state, the first state is switched to the second state. In the first state, the external acoustic signal is generated by the external sound source in response to a sound generation instruction signal. Accordingly, the internal acoustic signal is generated by the internal sound source in response to the sound generation instruction signal. In this case, an internal acoustic signal that is similar to the external acoustic signal having a desired mode is generated by the internal sound source. Accordingly, even if a failure occurs in the external acoustic signal, sound generation can be continued while suppressing a sense of incongruity felt by the user.

The mode of the internal acoustic signal and the external acoustic signal may include a timbre. According to this configuration, if a failure occurs in the external acoustic signal, an internal acoustic signal that is similar to the external acoustic signal having the desired timbre is generated by the internal sound source. Accordingly, it is possible to ensure continuity of the timbre of a generated sound.

The mode of the internal acoustic signal and the external acoustic signal may include an attribute of a timbre. According to this configuration, if a failure occurs in the external acoustic signal, an internal acoustic signal that is similar to the external acoustic signal having the attribute of the desired timbre is generated by the internal sound source. Accordingly, it is possible to ensure continuity of the timbre of a generated sound.

The electronic musical instrument may further include an acquisition means for acquiring correspondence information indicating the mode of the internal acoustic signal that is similar to the mode of the external acoustic signal, wherein when the first state is switched to the second state, the setting means sets the mode of the internal acoustic signal based on the acquired correspondence information. In this case, the mode of the internal acoustic signal can easily be set based on the correspondence information between the mode of the external acoustic signal and the mode of the internal acoustic signal.

The electronic musical instrument may further include a selection means for selecting correspondence information corresponding to the external sound source in the first state among a plurality of pieces of the correspondence information prepared in correspondence with a plurality of the external sound sources, wherein the acquisition means acquires the selected correspondence information. According to this configuration, even if the multiple external sound sources are in the first state, the mode of the internal acoustic signal can easily be set based on the correspondence information corresponding to the corresponding multiple external sound sources.

The electronic musical instrument may further include an identification means for identifying the external sound source in the first state, wherein the selection means selects the correspondence information corresponding to the identified external sound source. In this case, the correspondence information corresponding to the external sound source in the first state is automatically selected. For this reason, even if the multiple external sound sources are in the first state, the mode of the internal acoustic signal can be set more easily.

The electronic musical instrument may further include a reception means for receiving a selection of one of the plurality of pieces of corresponding information, wherein the selection means selects the correspondence information corresponding to the external sound source selected by the reception means. In this case, the user can select the correspondence information corresponding to the external sound source in the first state. For this reason, even if the multiple external sound sources are in the first state, the mode of the internal acoustic signal can be set more easily.

The external sound source may have the correspondence information, and the acquisition means may acquire the correspondence information from the external sound source. In this case, the correspondence information can easily be selected from the external sound source.

The electronic musical instrument may further include a calculation means for calculating a degree of similarity between the mode of the external acoustic signal generated by the external sound source and the mode of the internal acoustic signal generated by the internal sound source, wherein when the first state is switched to the second state, the setting means sets the mode of the internal acoustic signal based on the degree of similarity calculated by the calculation means. In this case, the mode of the internal acoustic signal can easily be set based on the degree of similarity between the mode of the external acoustic signal and the mode of the internal acoustic signal.

The electronic musical instrument may further include: an input means for receiving the external acoustic signal generated by the external sound source as a feedback acoustic signal; and a detection means for detecting a state of input of the feedback acoustic signal to the input means, wherein the switching means switches the first state to the second state in response to a transition from a state in which input of the feedback acoustic signal to the input means is normal, to a state in which input of the feedback acoustic signal to the input means is not normal. According to this configuration, when a failure occurs in the external acoustic signal supplied from the external sound source, the first state can be reliably switched to the second state.

The switching means may switch the second state to the first state in response to a transition from a state in which input of the feedback acoustic signal to the input means is not normal, to a state in which input of the feedback acoustic signal to the input means is normal. According to this configuration, when a failure in the external acoustic signal supplied from the external sound source is resolved, the second state can be reliably switched to the first state.

The switching means may switch the first state to the second state based on a user operation. According to this configuration, the user can switch the first state to the second state when the user notices a failure of the external acoustic signal.

An electronic musical instrument system according to one embodiment of the present invention includes: the above-described electronic musical instrument; one or more external sound sources connected to the electronic musical instrument; and a sound generation means for generating a sound based on an internal acoustic signal generated by the internal sound source of the electronic musical instrument and an external acoustic signal generated by the one or more external sound sources.

In this electronic musical instrument system, when a failure occurs in the external acoustic signal supplied from the external sound source in the first state, the first state is switched to the second state. In the first state, the external acoustic signal is generated by the external sound source in response to the sound generation instruction signal from the electronic musical instrument. Accordingly, the internal acoustic signal is generated by the internal sound source in response to the sound generation instruction signal. In this case, an internal acoustic signal that is similar to the external acoustic signal having the desired mode is generated by the internal sound source of the electronic musical instrument. Accordingly, even if a failure occurs in the external acoustic signal, sound generation can be continued while suppressing a sense of incongruity felt by the user.

A method according to an embodiment of the present invention includes the following:

(1) Generating a sound generation instruction signal in an electronic musical instrument including an internal sound source configured to generate an internal acoustic signal;

(2) Outputting the sound generation instruction signal from the electronic musical instrument to an external sound source configured to generate an external acoustic signal;

(3) Switching a first state in which the external acoustic signal is generated by the external sound source in response to the sound generation instruction signal to a second state in which the internal acoustic signal is generated by the internal sound source in response to the sound generation instruction signal; and (4) Automatically setting a mode of the internal acoustic signal such that the internal acoustic signal is generated with a mode similar to a mode of the external acoustic signal generated in the first state, when the first state is switched to the second state.

A program according to one embodiment of the present invention causes a computer to execute the following:

(1) Generating a sound generation instruction signal in an electronic musical instrument including an internal sound source for generating an internal acoustic signal;

(2) Outputting the sound generation instruction signal from the electronic musical instrument to an external sound source configured to generate an external acoustic signal;

(3) Switching a first state in which the external acoustic signal is generated by the external sound source in response to the sound generation instruction signal to a second state in which the internal acoustic signal is generated by the internal sound source in response to the sound generation instruction signal; and (4) Setting a mode of the internal acoustic signal such that the internal acoustic signal is generated with a mode similar to a mode of the external acoustic signal generated in the first state, when the first state is switched to the second state.

According to one embodiment of the present invention, even if a failure occurs in the external acoustic signal, sound generation can be continued while suppressing a sense of incongruity felt by the user.

BRIEF DESCRIPTION OF DRAWINGS

FIGS. 2A and 2B are diagrams showing an example of a correspondence table.

FIGS. 3A and 3B are diagrams showing an example of timbre category information of an external sound source and an internal sound source.

DETAILED DESCRIPTION OF THE PREFERRED EMBODIMENTS

Hereinafter, an electronic musical instrument and an electronic musical instrument system according to an embodiment of the present invention will be described in detail with reference to the drawings.

(1) Configuration of Electronic Musical Instrument System

Figure 1:
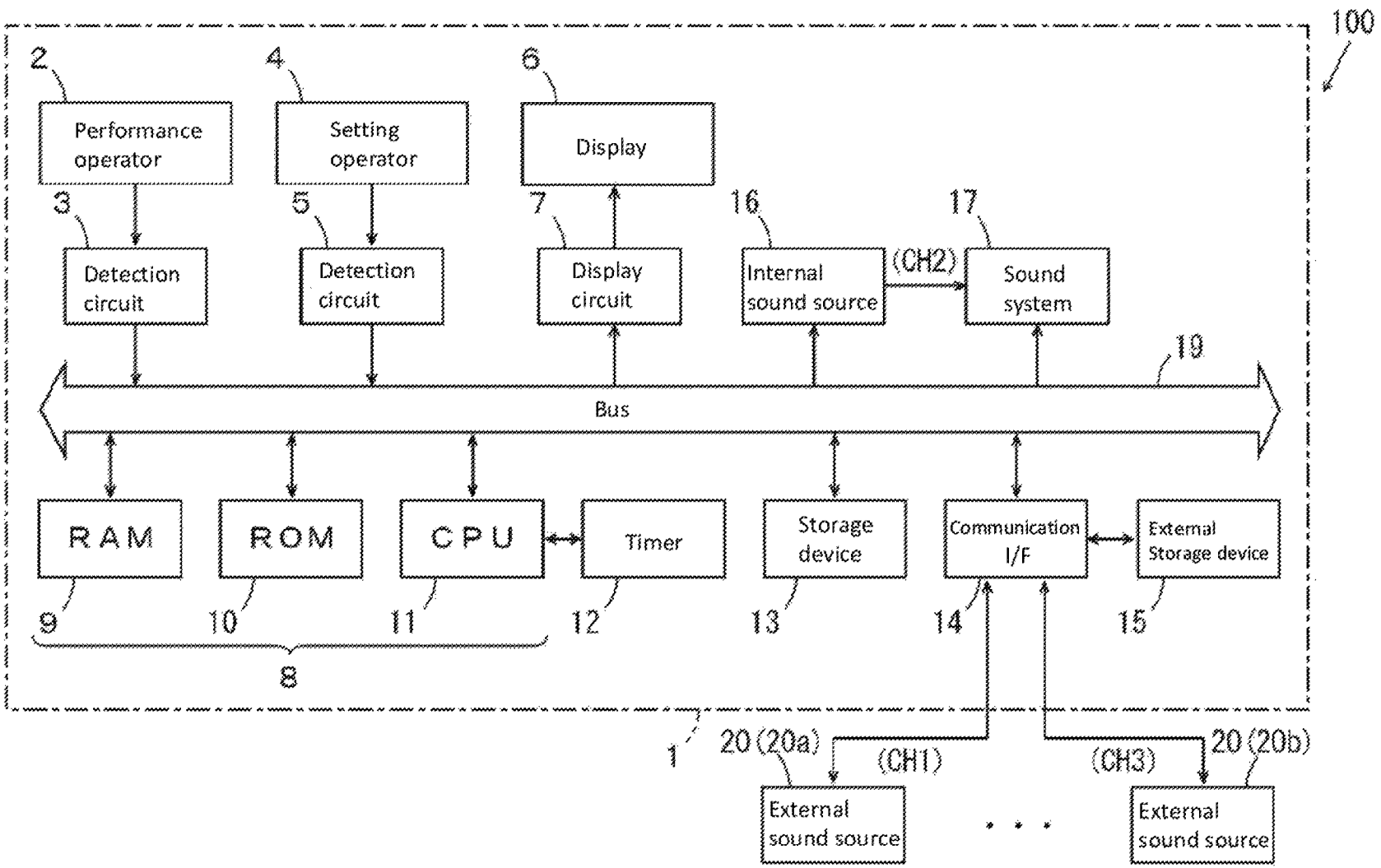
FIG. 1 is a block diagram showing a configuration of an electronic musical instrument system according to an embodiment of the present invention.

FIG. 1 is a block diagram showing a configuration of an electronic musical instrument system according to an embodiment of the present invention. An electronic musical instrument system 100 shown in FIG. 1 is constituted by an electronic musical instrument 1 and one or more external sound sources 20. In the present embodiment, multiple external sound sources 20*a* and 20*b* are connected to the electronic musical instrument 1. Hereinafter, if each of the multiple external sound sources 20 is to be distinguished, the external sound sources 20 will be called "external sound source 20*a*" or "external sound source 20*b*".

The electronic musical instrument 1 includes a performance operator 2, a detection circuit 3, a setting operator 4, a detection circuit 5, a display 6, and a display circuit 7. The performance operator 2 includes a keyboard, and a drum pad. The performance operation 2 is connected to a bus 19 via the detection circuit 3 and performance data obtained based on a performance operation performed by the user is input through the performance operator 2. The setting operator 4 includes a switch that is operated to be turned on or off, a rotary encoder that is operated by rotation, a linear encoder that is operated by sliding, or the like, and the setting operator 4 is connected to the bus 19 via the detection circuit 5. The setting operator 4 is used to perform switching of the timbre, adjustment of the volume, turning on and off of the power, and various types of settings.

The display 6 is connected to the bus 19 via the display circuit 7. A musical piece name, channel number, timbre name, parameter value, musical notation, or various other types of information are displayed on the display 6. The display 6 may also be a touch panel display. In this case, the user can instruct various operations by operating the display 6.

The electronic musical instrument 1 further includes a RAM (random access memory) 9, a ROM (read only memory) 10, a CPU (central processing unit) 11, a timer 12, a storage device 13, and a communication I/F (interface) 14. The RAM 9, the ROM 10, the CPU 11, the storage device 13, and the communication I/F 14 are connected to the bus 19, and the timer 12 is connected to the CPU 11. An external device such as an external storage device 15 may also be connected to the bus 19 via the communication I/F 14. The RAM 9, the ROM 10, and the CPU 11 form a sound source control unit 8.

The RAM 9 is composed of a volatile memory, for example, and is used as a work area for the CPU 11 and temporarily stores various types of data. The ROM 10 is composed of a non-volatile memory, for example, and stores computer programs such as a system program and a sound source control program. The CPU 11 performs later-described sound source control processing by executing a sound source control program stored in the ROM 10 on the RAM 9. The timer 12 gives time information such as the current time to the CPU 11.

The storage device 13 includes a storage medium such as a hard disk, an optical disk, a magnetic disk, or a memory card. The storage device 13 stores one or more pieces of musical piece data. Musical piece data is an acoustic signal (audio signal) expressing a musical piece. Here, the acoustic signal is composed of multiple sampling values obtained by sampling a waveform signal indicating a change in sound, at a predetermined sampling period. The musical piece data may be generated based on the performance data input from the performance operator 2 and stored in the storage device 13. The performance data and the musical piece data include later-described sound generation instruction signals. The above-described sound generation control program may also be stored in the storage device 13. Similarly to the storage device 13, the external storage device 15 may also include a storage medium such as a hard disk, an optical disk, a magnetic disk, or a memory card, and may store various types of data such as musical piece data, or a sound source control program.

Note that the sound source control program in the present embodiment may also be provided in a mode of being stored in a computer-readable storage medium, and may be installed in the ROM 10 or the storage device 13. Also, if the communication I/F 14 is connected to a communication network, a sound source control program distributed from a server connected to the communication network may also be installed in the ROM 10 or the storage device 13.

The electronic musical instrument 1 further includes an internal sound source 16 and a sound system 17. The internal sound source 16 is connected to the bus 19, and the sound system 17 is connected to the internal sound source 16 and the bus 19. The internal sound source 16 generates an acoustic signal based on the performance data input from the performance operator 2, the musical piece data obtained from the storage device 13, or the like, and adds an acoustic effect to the acoustic signal.

Each external sound source 20 is connected to the communication I/F 14, generates an acoustic signal based on the performance data input from the performance operator 2, the musical piece data obtained from the storage device 13, or the like, and adds an acoustic effect to the acoustic signal. Also, each external sound source 20 outputs the generated acoustic signal to the communication I/F 14. The sound system 17 includes a D/A (digital/analog) conversion circuit, an amplifier, and a speaker, and generates a musical tone obtained based on an acoustic signal provided from the internal sound source 16 or the external sound source 20.

In the present embodiment, the communication I/F 14 includes a MIDI (Musical Instrument Digital Interface) input terminal, a MIDI output terminal, an audio input terminal, and an audio output terminal. The communication I/F 14 and the external sound sources 20 are connected using a MIDI cable and an audio cable, and perform communication based on the MIDI standard. Also, in the present embodiment, the electronic musical instrument 1 has multiple MIDI channels (hereinafter referred to simply as "channels"). Different channels CH1 and CH3 are allocated to the multiple external sound sources 20*a* and 20*b* respectively, and a channel CH2 is allocated to the internal sound source 16.

(2) Operation of Sound Source Control Unit 8

The user of the electronic musical instrument shown in FIG. 1 can set a desired timbre selected from multiple timbres in the internal sound source 16 and the external sound sources 20 by operating the setting operator 4. An acoustic effect parameter such as "Cutoff" or "Attack Time" may also be added to the timbre. The internal sound source 16 generates an acoustic signal with the set timbre when the sound generation instruction signal is provided. The external sound sources 20 generate acoustic signals with the set timbre when the sound generation instruction signal is provided. Accordingly, the user can play the electronic musical instrument 1 while causing musical tones with various timbres to be reproduced from the sound system 17. Hereinafter, the acoustic signal generated by the internal sound source 16 will be referred to as an "internal acoustic signal" and the acoustic signals generated by the external sound sources 20 will be referred to as "external acoustic signals".

For the channels allocated to the external sound sources 20, when a connection failure between the external sound sources 20 and the communication I/F 14, disconnection of communication between the external sound sources 20 and the communication I/F 14, a failure of the external sound sources 20, or the like occurs, a failure of the external acoustic signals occurs in some cases. A failure of an external acoustic signal means a state in which an external acoustic signal is not provided from an external sound source 20 to the electronic musical instrument 1, a state in which the external acoustic signal provided from the external sound source 20 to the electronic musical instrument 1 is cut off, a state in which the external acoustic signal provided from the external sound source 20 to the electronic musical instrument 1 is unstable, or the like. When such a failure of an external acoustic signal occurs (if the state of input of an external acoustic signal is not normal), the desired musical tone cannot be generated from the sound system 17.

In view of this, when a failure of an external acoustic signal occurs in a channel allocated to an external sound source 20, the sound source control unit 8 switches the external acoustic signals to the internal acoustic signal of the internal sound source 16. In this case, the sound source control unit 8 sets the timbre of the internal acoustic signal of the internal sound source 16 such that the internal acoustic signal is generated with a timbre having a predetermined degree of similarity to the timbre of the external acoustic signal (i.e., a similar timbre). Also, the sound source control unit 8 provides the internal sound source 16 with the sound generation signals that are to be provided to the external sound sources 20. Accordingly, an internal acoustic signal with a timbre that is similar to the timbre of the external acoustic signal is generated by the internal sound source 16. Accordingly, the user can continue playing the electronic musical instrument 1 while causing generation of a musical tone with a desired timbre from the sound system 17, even when a failure of the external acoustic signal occurs. Note that the timbre that is similar to the timbre of the external acoustic signal also includes a timbre that is identical to the timbre of the external acoustic signal.

The setting of the timbre of the internal sound source 16 that is similar to the timbre of the above-described external sound sources 20 may be performed manually by the user, or may be performed automatically instead of being performed by the user. The user can set a timbre similar to the timbre of the external sound sources 20 for the internal sound source 16 by operating the setting operator 4. Also, the sound source control unit 8 can acquire a correspondence table indicating the correspondence relationship between the timbres of the external sound sources 20 and the timbres of the internal sound source 16 that have a given degree of similarity thereto, and can set a timbre similar to the timbre of the external sound sources 20 for the internal sound source 16 based on the correspondence table, without relying on the user.

FIGS. 2A and 2B are diagrams showing examples of correspondence tables. Correspondence table T1 shown in FIG. 2A shows correspondence relationships between the timbres of the external sound source 20*a* and the timbres of the internal sound source 16, and correspondence table T2 shown in FIG. 2B shows correspondence relationships between the timbres of the external sound source 20*b* and the timbres of the internal sound source 16.

According to the correspondence table T1, timbres "piano a1", "piano b1", and "piano c1" of the external sound source 20*a* respectively correspond to timbres "piano A", "piano B", and "piano C" of the internal sound source 16. Timbres "guitar a1", "guitar b1", and "guitar c1" of the external sound source 20*a* respectively correspond to timbres "guitar A", "guitar B", and "guitar C" of the internal sound source 16. Timbres "bass a1", "bass b1", and "bass c1" of the external sound source 20*a* respectively correspond to timbres "bass A", "bass B", and "bass C" of the internal sound source 16.

According to the correspondence table T2, timbres "piano a2", "piano b2", and "piano c2" of the external sound source 20*b* respectively correspond to timbres "piano A", "piano B", and "piano C" of the internal sound source 16. Timbres "guitar a2", "guitar b2", and "guitar c2" of the external sound source 20*b* respectively correspond to timbres "guitar A", "guitar B", and "guitar C" of the internal sound source 16. Timbres "bass a2", "bass b2", and "bass c2" of the external sound source 20*b* respectively correspond to timbres "bass A", "bass B", and "bass C" of the internal sound source 16.

The correspondence tables T1 and T2 may also be stored in advance in the storage device 13. If the external sound sources 20*a* and 20*b* respectively have the correspondence tables T1 and T2, the correspondence tables T1 and T2 may also be respectively acquired from the external sound sources 20*a* and 20*b*. Alternatively, if the communication I/F 14 is connected to a communication network, the correspondence tables T1 and T2 may also be acquired from a server connected to the communication network.

Also, the sound source control unit 8 may acquire category information of the timbres of the external sound sources 20 and the internal sound source 16, and may also set timbres that are similar to the timbres of the external sound sources 20 for the internal sound source 16 based on the category information, without relying on the user. The category information includes multiple main categories indicating the timbres, and multiple sub-categories belonging to the main categories. FIGS. 3A and 3B are diagrams showing an example of timbre category information of the external sound sources 20 and the internal sound source 16. FIG. 3A shows category information C1 of the timbres of the internal sound source 16, and FIG. 3B shows category information C2 of the timbres of the external sound sources 20.

The category information C1 is stored in advance in the storage device 13 and the category information C2 is acquired from the external sound source 20. The category information C1 and C2 may also be stored in advance in the storage device 13. Alternatively, if the communication I/F 14 is connected to a communication network, the category information C1 and C2 may also be acquired from a server connected to the communication network.

According to the category information C1 of the internal sound source 16, the timbres "piano A", "piano B", and "piano C" belong to the timbre "piano". The timbres "guitar A", "guitar B", and "guitar C" belong to the timbre "guitar". The timbres "bass A", "bass B", and "bass C" belong to the timbre "bass".

According to the category information C2 of the external sound sources 20, the timbres "piano a", "piano b", "piano c", and "piano d" belong to the timbre "piano". The timbres "guitar a", "guitar b", "guitar c", and "guitar d" belong to the timbre "guitar". The timbres "bass a", "bass b", "bass c", and "bass d" belong to the timbre "bass".

The sound source control unit 8 selects the timbre of the internal sound source 16 that is similar to the set timbre of the external sound source 20 by calculating the degree of similarity between the timbre of the external sound source 20 and the timbre of the internal sound source 16. Specifically, the sound source control unit 8 specifies a character string indicating the sub-category of the timbre set for the external sound source 20 in the timbre category information C2, and selects a character string that is similar to the specified character string from the sub-categories of the category information C1. If no character string that is similar to the specified character string exists in the sub-categories of the category information C1, the sound source control unit 8 may specify the main category of the timbre set for the external sound source 20 in the category information C2, and may select a character string similar to the specified character string from the main categories of the category information C1. The sound source control unit 8 sets the selected timbre for the internal sound source 16.

For example, the similar timbre may also be selected from the category information C1 by calculating the Levenshtein distance (edit distance) between the character string indicating the timbre of the external sound sources 20 and the character string indicating the timbre of the internal sound source 16, or the similar timbre may also be selected from the category information C1 in accordance with another rule.

For example, in the selection of the similar timbre, a calculation procedure may also be used in which a similar word is deemed as having a high degree of similarity based on similarity information indicating a similarity relationship of multiple words. Alternatively, if tags such as "warm sound", "sharp sound", or "piano" are added to the categories or sub-categories, a calculation procedure may also be used in which categories or sub-categories with more matching tags are deemed as having a higher degree of similarity.

In the example shown in FIGS. 3A and 3B, "piano A", "piano B", and "piano C" of the category information C1 are respectively selected as the timbres that are similar to the timbres "piano a", "piano b", and "piano c" of the category information C2. One of "piano A", "piano B", and "piano C" of the category information C1 is selected as the timbre that is similar to the timbre "piano d" of the category information C2.

Also, the main categories or sub-categories of the category information C1 and C2 are constituted by multiple tags in some cases. In this case, the timbres of the main categories or sub-categories of the category information C1 that completely match the tags of the main categories or the sub-categories of the category information C2 may also be selected as the similar timbres.

Also, if attributes of the timbres of the external sound source 20 are specified, the set timbre of the internal sound source 16 may also be adjusted in correspondence with the attribute (i.e., such that an attribute having a given degree of similarity to the attribute is provided to the timbre of the internal sound source 16). For example, the cutoff frequency of the set timbre of the internal sound source 16 may also be adjusted in correspondence with attributes such as "bright" and "dark". Furthermore, the sound source control unit 8 may also have an edit function, a save function, and a load function for the attributes in the correspondence table or the category information.

(3) Functional Configuration of Sound Source Control Unit 8

Figure 4:
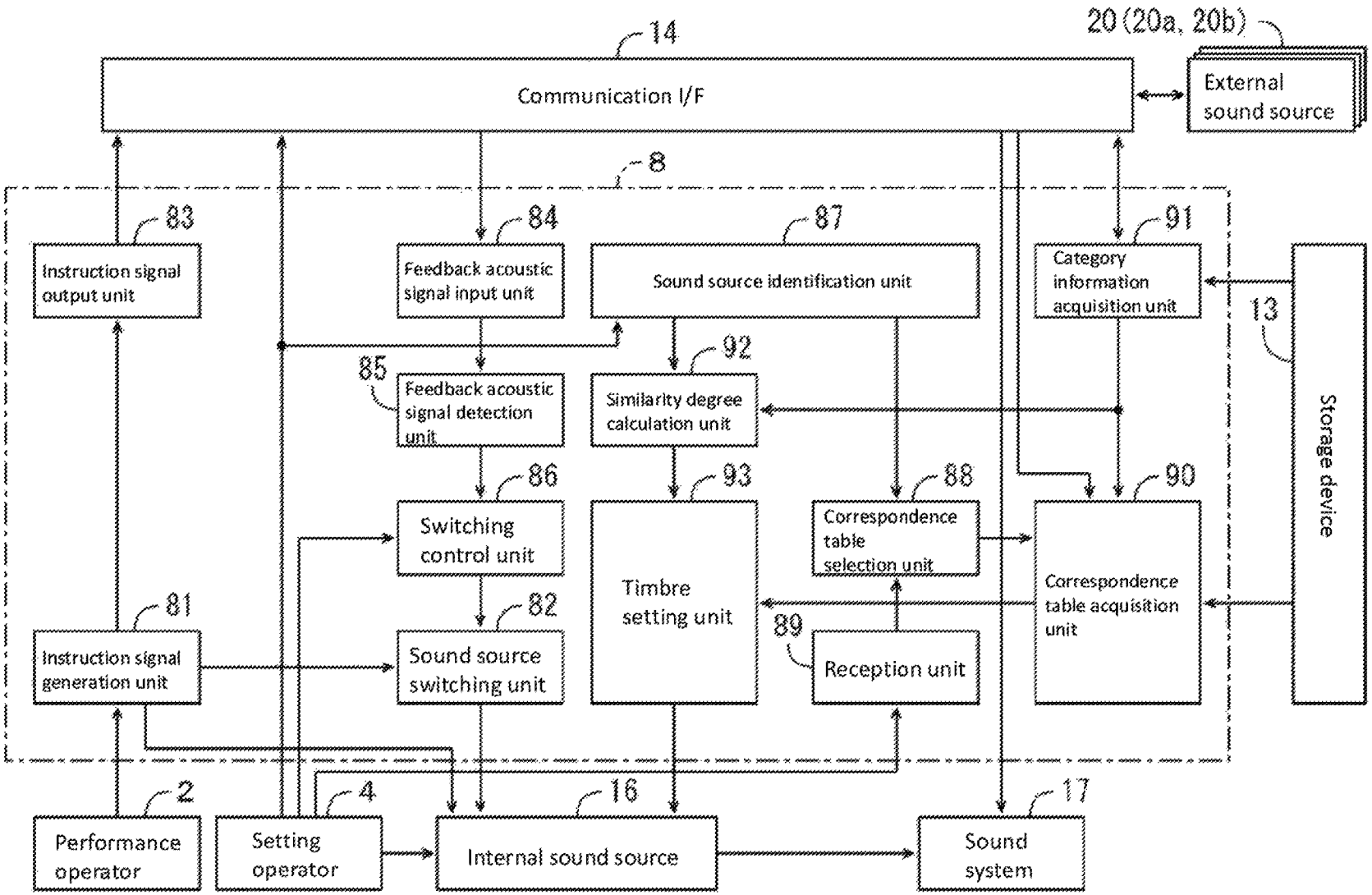
FIG. 4 is a block diagram showing a functional configuration of a sound source control unit shown in FIG. 1.

FIG. 4 is a block diagram showing a functional configuration of the sound source control unit 8 shown in FIG. 1. As shown in FIG. 4, the sound source control unit 8 includes an instruction signal generation unit 81, a sound source switching unit 82, an instruction signal output unit 83, a feedback acoustic signal input unit 84, a feedback acoustic signal detection unit 85, and a switching control unit 86. Also, the sound source control unit 8 further includes a sound source identification unit 87, a correspondence table selection unit 88, a reception unit 89, a correspondence table acquisition unit 90, a category information acquisition unit 91, a similarity degree calculation unit 92, and a timbre setting unit 93. The functions of the units of the sound source control unit 8 shown in FIG. 4 are realized by the CPU 11 shown in FIG. 1 executing a sound source control program stored in the ROM 10 or the storage device 13.

The instruction signal generation unit 81 generates various instruction signals such as a sound generation instruction signal for each channel, based on an operation of the performance operator 2 or musical piece data. Among the sound generation instruction signals generated by the instruction signal generation unit 81, the sound generation instruction signal to be provided to the internal sound source 16 is provided to the internal sound source 16. Among the sound generation instruction signals generated by the instruction signal generation unit 81, the sound generation instruction signals to be provided to the external sound sources 20 are provided to the sound source switching unit 82 and the instruction signal output unit 83. In the present embodiment, the sound generation instruction signal of the channel CH2 is provided to the internal sound source 16, and the sound generation instruction signals of the channels CH1 and CH3 are provided to the external sound sources 20. Supply of the sound generation instruction signal to the internal sound source 16 or the external sound sources 20 is switched using a local OFF command and a local ON command based on the MIDI standard, for example. The sound source switching unit 82 can, for each channel, switch between a connected state in which the acquired sound generation instruction signal is provided to the internal sound source 16, and a non-connected state in which the acquired sound generation instruction signal is not provided to the internal sound source 16.

The instruction signal output unit 83 is connected to the communication I/F 14 and outputs the sound generation instruction signals generated by the instruction signal generation unit 81 to the external sound sources 20. The external sound sources 20 generate the external acoustic signals in response to the sound generation instruction signal and input the generated external acoustic signals to the communication I/F 14. The feedback acoustic signal input unit 84 acquires the external acoustic signals from the communication I/F 14 as feedback acoustic signals (audio return). The feedback acoustic signal detection unit 85 detects the state of input of the feedback acoustic signals to the feedback acoustic signal input unit 84.

The switching control unit 86 sets the sound source switching unit 82 to the non-connected state if the state of input of the feedback acoustic signals detected by the feedback acoustic signal detection unit 85 is normal. Accordingly, musical tones obtained based on the external acoustic signals are generated from the sound system 17. On the other hand, the switching control unit 86 switches the sound source switching unit 82 to the connected state if the state of input of the feedback acoustic signals detected by the feedback acoustic signal detection unit 85 is not normal. Accordingly, a musical tone obtained based on the internal acoustic signal is generated from the sound system 17. At this time, input of the feedback acoustic signal from the feedback acoustic signal input unit 84 may also be turned off.

It is also possible to switch the sound source switching unit 82 to the connected state or the non-connected state based on an operation of the performance operator 4 performed by the user. For this reason, if the user notices a failure in the external acoustic signals, the user can switch the sound source switching unit 82 from the non-connected state to the connected state. Also, if the user notices that the failure of the external acoustic signals has been resolved, the user can switch the sound source switching unit 82 from the connected state to the non-connected state.

The sound source identification unit 87 identifies the type of each external sound source 20 connected to the communication I/F 14 and identifies the timbre set for each external sound source 20, based on an operation of the performance operation 4 performed by the user. The correspondence table selection unit 88 selects a correspondence table corresponding to each external sound source 20 identified by the sound source identification unit 87. Also, the user can select a correspondence table corresponding to each external sound source 20 connected to the communication I/F 14 by operating the setting operator 4. The reception unit 89 receives a selection of a correspondence table from the setting operator 4.

The correspondence table acquisition unit 90 acquires the correspondence table corresponding to the external sound source 20 from the storage device 13 based on selection performed by the correspondence table selection unit 88 or the reception unit 89. The correspondence table acquisition unit 90 can acquire the correspondence table from the external sound source 20 or a server connected to the communication network, via the communication I/F 214. Alternatively, the correspondence table acquisition unit 90 may also generate the correspondence table based on the category information of the internal sound source 16 and the category information of the external sound source 20 (later-described correspondence table generation processing).

The category information acquisition unit 91 acquires the category information corresponding to the internal sound source 16 from the storage device 13 and acquires the category information corresponding to the external sound source 20 from the external sound source 20 via the communication I/F 14. If the state of input of the feedback acoustic signal is not normal, there is a possibility that a failure of the communication I/F 14 is the cause. In view of this, the category information acquisition unit 91 may also acquire the category information corresponding to the external sound source 20 in advance or periodically. The category information acquisition unit 91 can also acquire category information corresponding to the internal sound source 16 and the external sound source 20 from a server connected to the communication network. The similarity degree calculation unit 92 calculates the degree of similarity between the timbre of the external acoustic signal and the mode of the internal acoustic signal based on the category information acquired by the category information acquisition unit 91.

The timbre setting unit 93 acquires the correspondence table acquired by the correspondence table acquisition unit 90 or the degree of similarity calculated by the similarity degree calculation unit 92. Also, the timbre setting unit 93 sets the timbre of the internal sound source 16 based on the acquired correspondence table or degree of similarity, so as to generate an internal acoustic signal with a timbre that is similar to the timbre of the external acoustic signal obtained when the sound source switching unit 82 is in the non-connected state (the external acoustic signal obtained when a musical tone obtained based on the external acoustic signal is generated from the sound system 17). When the timbre setting unit 93 sets the timbre of the internal sound source 16, the user can select which of the correspondence table and the degree of similarity is to be used.

(4) Correspondence Table Generation Processing

Figure 5:
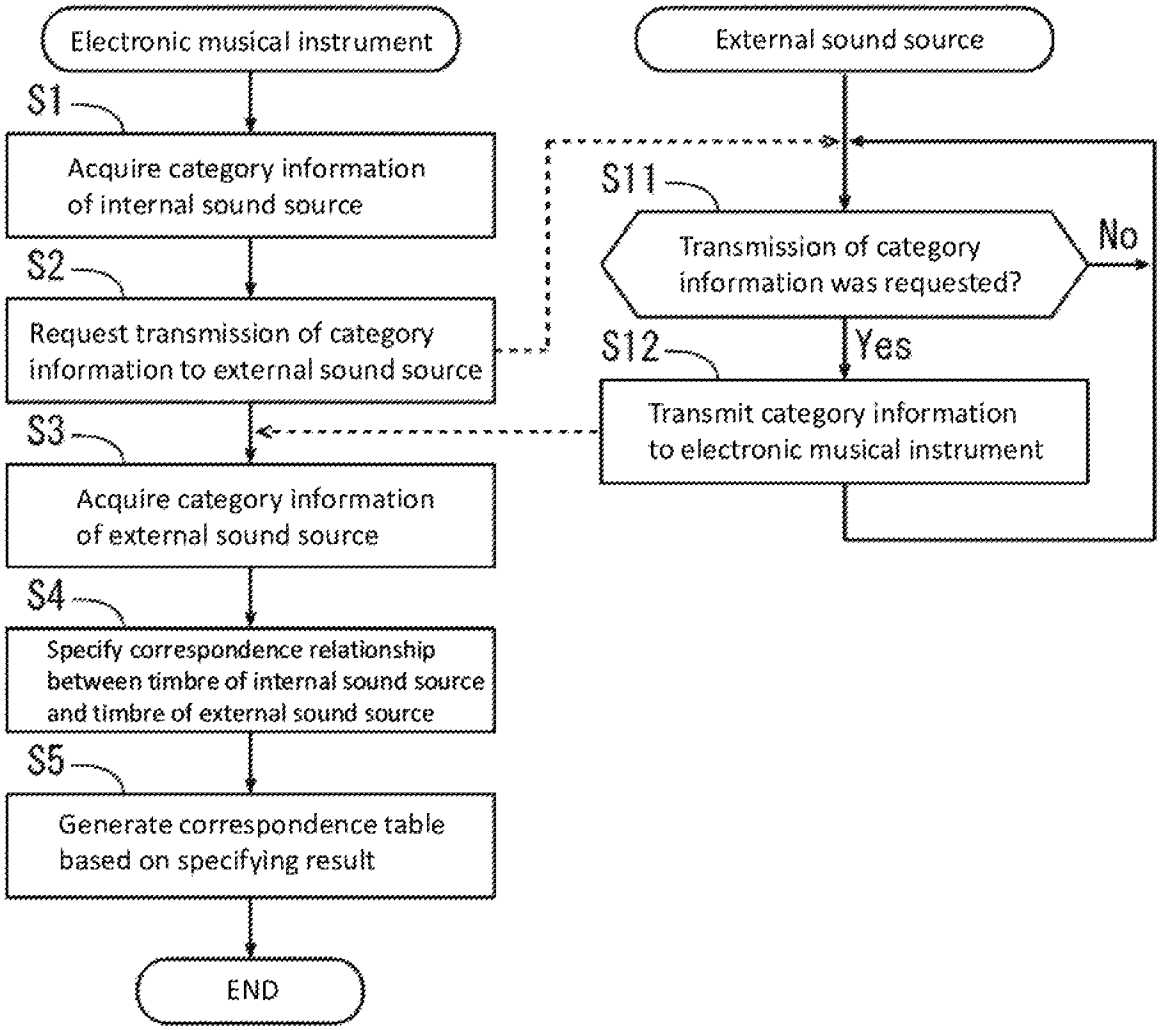
FIG. 5 is a flowchart showing correspondence table generation processing performed by a sound source control unit.

FIG. 5 is a flowchart showing correspondence table generation processing performed by the sound source control unit 8. The correspondence table generation processing shown in FIG. 5 is performed by the CPU 11 shown in FIG. 1 executing a correspondence table generation program stored in the ROM 10 or the storage device 13. Correspondence table generation processing performed by the sound source control unit 8 of the electronic musical instrument 1 is shown on the left in FIG. 5, and processing performed by the control unit of the external sound source 20 connected to the instruction signal output unit 83 (FIG. 4) is shown on the right in FIG. 5.

First, the category information acquisition unit 91 shown in FIG. 4 acquires the category information C1 (FIG. 3A) of the internal sound source 16 from the storage device 13, for example (step S1). Next, the category information acquisition unit 91 requests transmission of the category information C2 (FIG. 3B) to the external sound source 20 connected to the instruction signal output unit 83 (step S2).

The control unit of the external sound source 20 determines whether or not transmission of the category information C2 was requested from the category information acquisition unit 91 (step S11). If transmission of the category information C2 has not been requested, the control unit of the external sound source 20 waits until transmission of the category information C2 is requested from the category information acquisition unit 91. If transmission of the category information C2 is requested, the control unit of the external sound source 20 transmits the category information C2 to the category information acquisition unit 91 (step S12).

If the category information C2 was transmitted from the external sound source 20 to the category information acquisition unit 91 in step S12, the category information acquisition unit 91 acquires the category information C2 of the external sound source 20 (step S3). Step S3 is not executed at this time, but may be executed in advance or may be executed periodically. Next, based on the category information C1 and C2 acquired by the category information acquisition unit 91, the correspondence table acquisition unit 90 specifies the correspondence relationship between the timbre of the internal sound source 16 and the timbre of the external sound source 20 (step S4). Thereafter, the correspondence table acquisition unit 90 creates the correspondence table T1 based on the specifying result (step S5) and ends the correspondence table generation processing.

(5) Sound Source Control Processing

Figure 6:
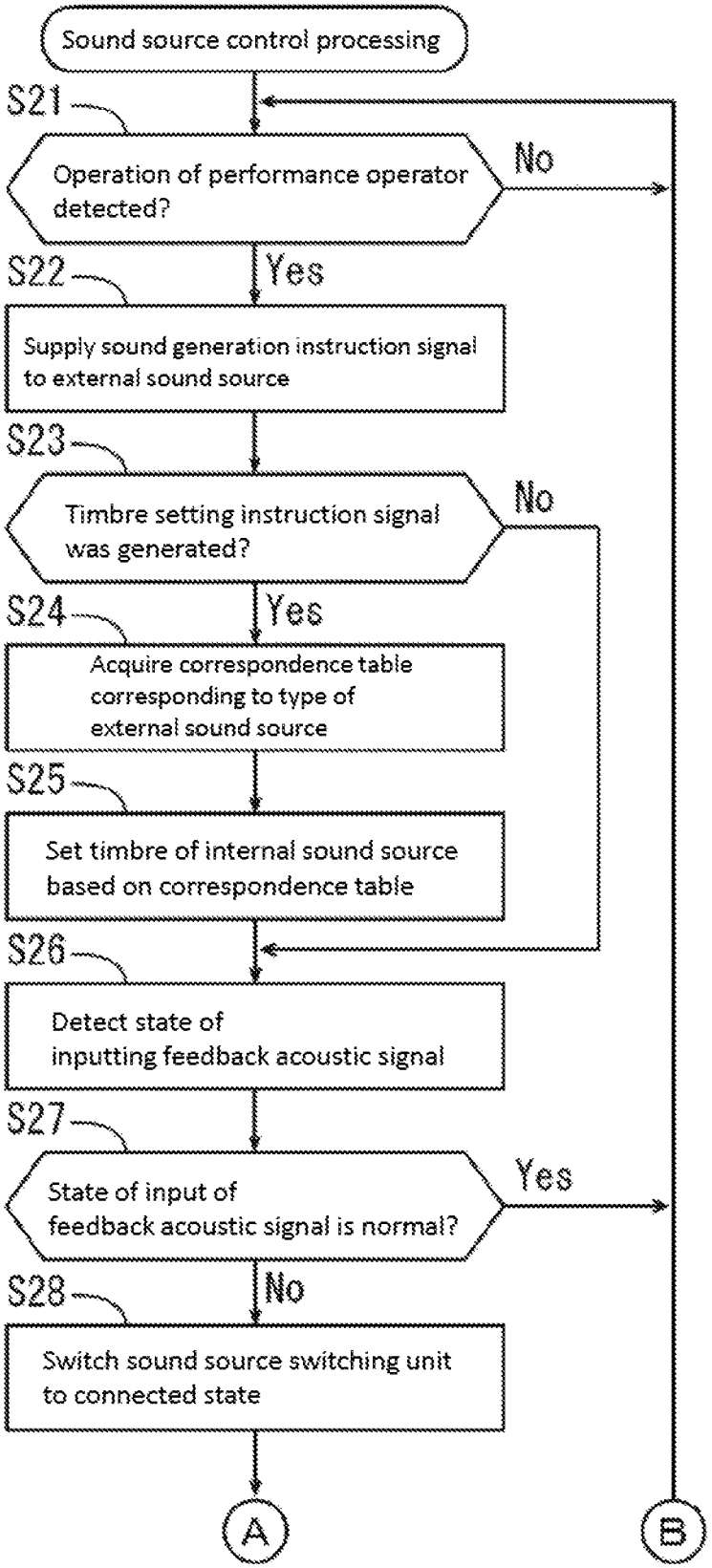
FIG. 6 is a flowchart showing sound source control processing performed by the sound source control unit.
Figure 7:
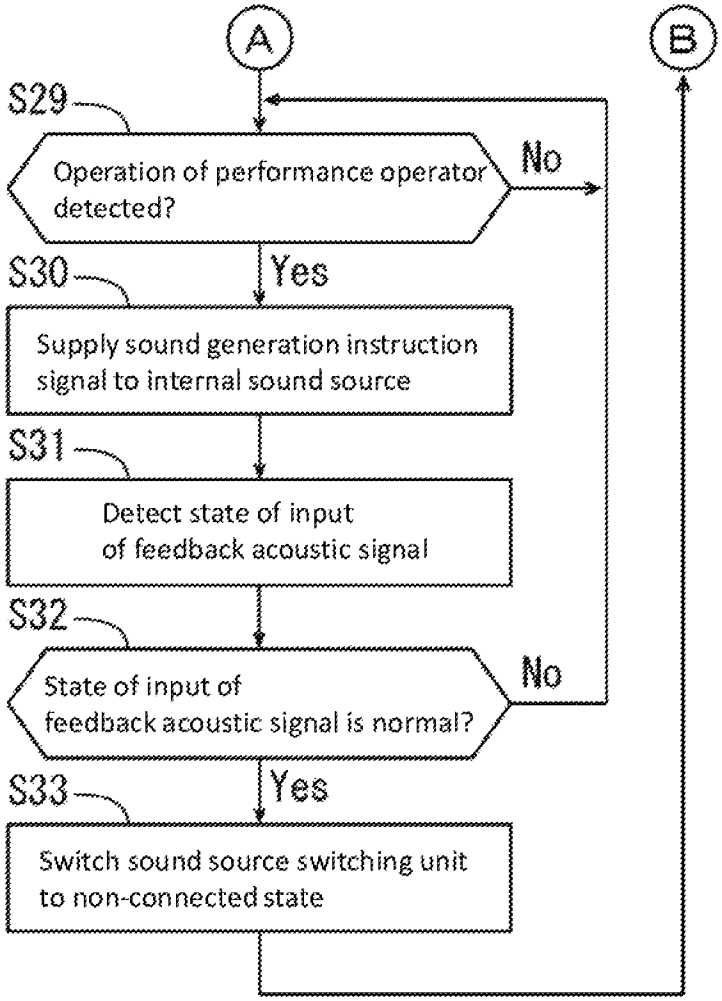
FIG. 7 is a flowchart showing sound source control processing performed by the sound source control unit.

FIGS. 6 and 7 are flowcharts showing sound source control processing performed by the sound source control unit 8. The sound source control processing shown in FIGS. 6 and 7 is performed by the CPU 11 shown in FIG. 1 executing a sound source control program stored in the ROM 10 or the storage device 13. The following sound source control processing is performed on each channel allocated to the external sound sources 20. In the initial state, the sound source switching unit 82 shown in FIG. 4 is in a non-connected state.

First, the instruction signal generation unit 81 determines whether or not an operation of the performance operator 2 has been detected (step S21). If no operation of the performance operator 2 has been detected, the instruction signal generation unit 81 waits until an operation of the performance operator 2 is detected. If an operation of the performance operator 2 has been detected, the instruction signal generation unit 81 generates the sound generation instruction signal and supplies the sound generation instruction signal to the external sound source 20 via the instruction signal output unit 83 and the communication I/F 14 (step S22). The external sound source 20 generates an external acoustic signal with a set timbre when the sound generation instruction signal is provided. The external acoustic signal generated by the external sound source 20 is supplied to the sound system 17 through the communication I/F 14.

Next, the sound source identification unit 87 determines whether or not a timbre setting instruction signal has been generated based on an operation of the setting operator 4 (step S23). The timbre setting instruction signal includes information indicating the type of the external sound source 20 and the set timbre. If the timbre setting instruction signal has not been generated, the processing advances to step S26. If the timbre setting instruction signal has been generated, the correspondence table acquisition unit 90 acquires the correspondence table corresponding to the type of the external sound source 20 (step S24). Thereafter, the timbre setting unit 93 sets the timbre of the internal sound source 16 based on the correspondence table (step S25).

Next, the feedback acoustic signal detection unit 85 detects the state of input of the feedback acoustic signal to the feedback acoustic signal input unit 84 (step S26) and determines whether or not the state of input of the feedback acoustic signal is normal (step S27). If the state of input of the feedback acoustic signal is normal, the feedback acoustic signal detection unit 85 returns to step S21. In this case, generation of the musical tone obtained based on the external acoustic signal from the external sound source 20 is continued.

In step S27, if input of the feedback acoustic signal exists at a suitable timing (e.g., if the feedback acoustic signal is input at a timing corresponding to the sound generation instruction signal) or the like, it may automatically be determined that the state of input of the feedback acoustic signal is normal. Alternatively, the user may determine whether or not the state of input of the feedback acoustic signal is normal by listening to the generated sound, and may input (set) the result by using the setting operator 4, for example. The same also applies to later-described step S32.

On the other hand, if the state of input of the feedback acoustic signal is not normal, the switching control unit 86 switches the sound source switching unit 82 to the connected state (step S28) and advances to step S29. Accordingly, generation of the musical tone obtained based on the internal acoustic signal from the internal sound source 16 instead of the external sound source 20 is continued. Since a timbre that is similar to the timbre of the external sound source 20 is set for the internal sound source 16, the continuity of the timbre of the musical tone generated from the electronic musical instrument is ensured. At the time of switching the sound source switching unit 82 to the connected state, the sound system 17 may be controlled such that the volume of the musical tone gradually increases (feed-in function).

In step S29, the instruction signal generation unit 81 determines whether or not an operation of the performance operator 2 was detected (step S29). If no operation of the performance operator 2 has been detected, the instruction signal generation unit 81 waits until an operation of the performance operator 2 is detected. If an operation of the performance operator 2 has been detected, the instruction signal generation unit 81 generates the sound generation instruction signal and supplies the sound generation instruction signal to the internal sound source 16 via the sound source switching unit 82 (step S30). The internal sound source 16 generates the internal acoustic signal with the set timbre when the sound generation instruction signal is provided. The internal acoustic signal generated by the internal sound source 16 is supplied to the sound system 17.

Next, the feedback acoustic signal detection unit 85 detects the state of input of the feedback acoustic signal to the feedback acoustic signal input unit 84 (step S31) and determines whether or not the state of input of the feedback acoustic signal is normal (step S32). If the state of input of the feedback acoustic signal is not normal, the feedback acoustic signal detection unit 85 returns to step S29. In this case, generation of the musical tone obtained based on the internal acoustic signal from the internal sound source 16 is continued.

On the other hand, if the state of input of the feedback acoustic signal is normal, the switching control unit 86 switches the sound source switching unit 82 to the non-connected state (step S33) and returns to step S21. Accordingly, generation of the musical tone obtained based on the external acoustic signal from the external sound source 20 is once again continued. The processing of step S33 may also be executed at a time during which none of the sound generation instruction signals have been generated.

(6) Parameter Region (Zone) Setting

The user can cause the sound source control unit 8 to generate the sound generation instruction signal by operating the performance operator 2. The sound generation instruction signal includes parameters such as pitch and velocity. Also, the user can set multiple regions in the range of the values of the parameters included in the sound generation instruction signal. Here, the multiple set regions may overlap with each other. The channels can be respectively allocated to the multiple set regions. Accordingly, the sound generation instruction signals can be provided separately to the internal sound source 16 and the external sound sources 20. The region setting is used in a local ON state set according to a local ON command based on the MIDI standard, for example.

Figure 8:
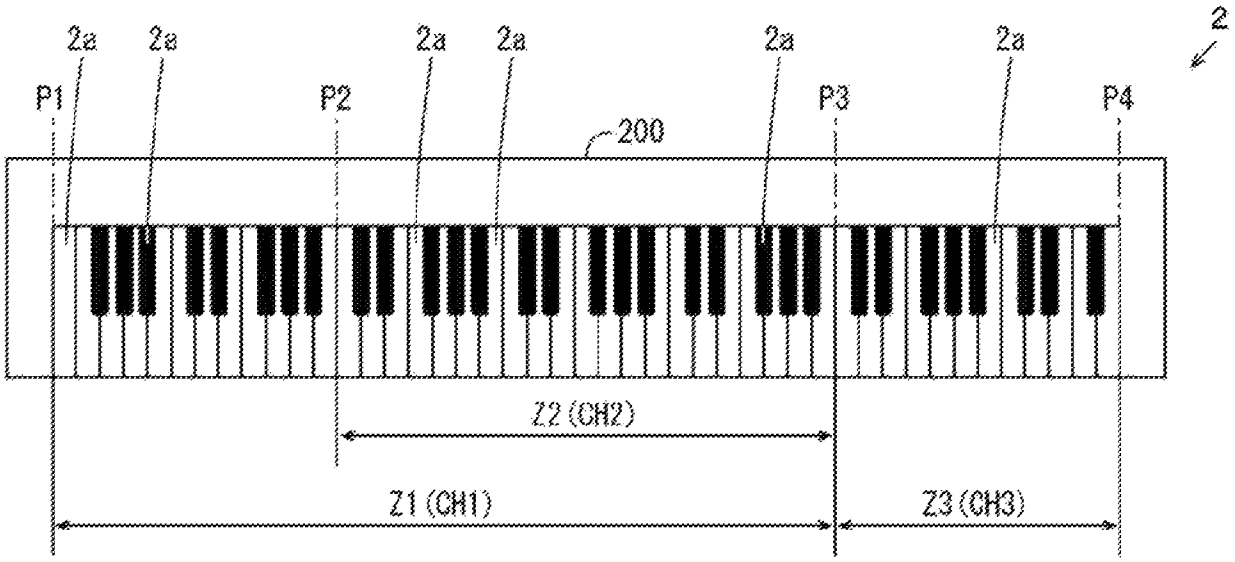
FIG. 8 is a diagram for illustrating an example of parameter region setting.

FIG. 8 is a diagram for illustrating an example of parameter region setting. As shown in FIG. 8, the performance operator 2 includes the keyboard 200. The keyboard 200 includes multiple keys 2*a* arranged in alignment in the left-right direction. The multiple keys 2*a* correspond to multiple respective pitches. The user can cause generation of a sound generation instruction signal including a corresponding pitch by pressing a desired key 2*a*.

In the example shown in FIG. 8, three regions Z1, Z2, and Z3 are set with respect to the pitch of the sound generation instruction signal. Specifically, four positions P1, P2, P3, and P4 are set in the keyboard 200 so as to be aligned in the stated order from left to right. The region Z1 is the region of the pitches corresponding to the keys 2*a* arranged between the positions P1 and P3. The region Z2 is the region of the pitches corresponding to the keys 2*a* arranged between the positions P2 and P3. The region Z3 is the region of the pitches corresponding to the keys 2*a* arranged between the positions P3 and P4.

For example, the channels CH1, CH2, and CH3 are allocated to the regions Z1, Z2, and Z3 respectively. In this case, when one of the keys 2*a* between the positions P1 and P2 is pressed, the sound generation instruction signal for the corresponding pitch is provided to the external sound source 20*a* of the channel CH1. When one of the keys 2*a* between the positions P2 and P3 is pressed, the sound generation instruction signal for the corresponding pitch is provided to the internal sound source 16 of the channel CH2 and the external sound source 20 of the channel CH1. When one of the keys 2*a* between the positions P3 and P4 is pressed, the sound generation instruction signal for the corresponding pitch is provided to the external sound source 20*b* of the channel CH3.

In the present example, for each of the channels CH1 and CH3 allocated to the regions Z1 and Z3, the correspondence table generation processing shown in FIG. 5 and the sound source control processing shown in FIGS. 6 and 7, which are performed by the sound source control unit 8 shown in FIG. 4, are performed.

Figure 9:
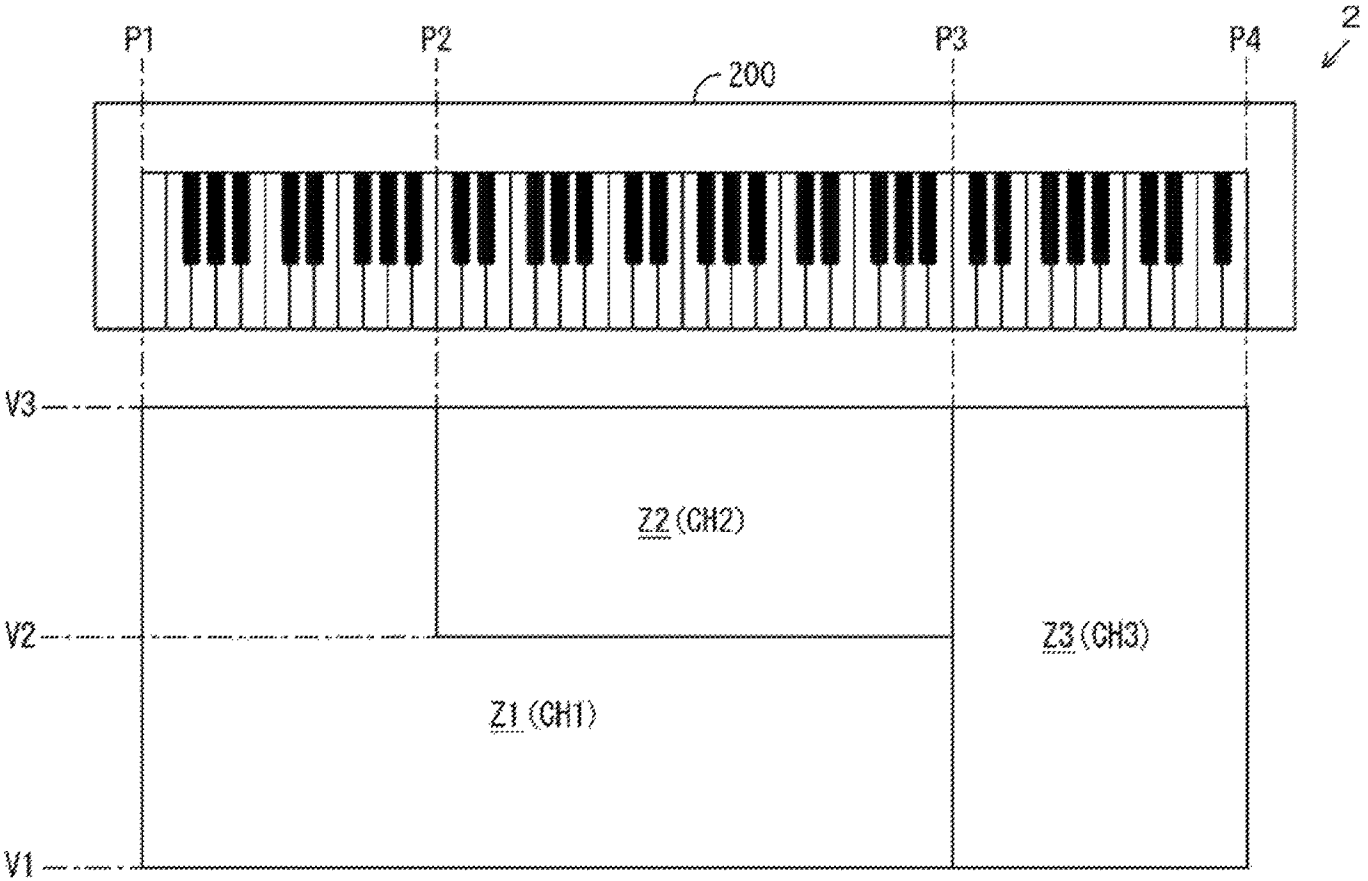
FIG. 9 is a diagram for illustrating another example of parameter region setting.

FIG. 9 is a diagram for illustrating another example of parameter region setting. In the example shown in FIG. 9, three regions Z1, Z2, and Z3 are set for combinations of the pitches and velocities of the sound generation instruction signal. Specifically, values V1, V2, and V3 of the three velocities are further set in addition to the four positions P1, P2, P3, and P4 shown in FIG. 8. The value V2 is greater than the value V1, and the value V3 is greater than the value V2.

The region Z1 includes the region of the pitches corresponding to the keys 2*a* arranged between the positions P1 and P2 and the velocities between the values V1 and V3, and the region of the pitches corresponding to the keys 2*a* arranged between the positions P2 and P3 and the velocities between the values V1 and V2. The region Z2 is the region of the pitches corresponding to the keys 2*a* arranged between the positions P2 and P3 and the velocities between the values V2 and V3. The region Z3 is the region of the pitches corresponding to the keys 2*a* arranged between the positions P3 and P4 and the velocities between the values V1 and V3.

Similarly to the example shown in FIG. 8, the channels CH1 to CH3 are allocated to the regions Z1, Z2, and Z3 respectively. In this case, if one of the keys 2*a* between the positions P1 and P2 is pressed at a velocity between the values V1 and V3, a sound generation instruction signal having the corresponding pitch and the value of the velocity is provided to the external sound source 20*a* of the channel CH1. If one of the keys 2*a* between the positions P2 and P3 is pressed at a velocity between the values V1 and V2, a sound generation instruction signal having the corresponding pitch and the value of the velocity is provided to the external sound source 20*a* of the channel CH1. If one of the keys 2*a* between the positions P2 and P3 is pressed at a velocity between the values V2 and V3, a sound generation instruction signal having the corresponding pitch and the value of the velocity is provided to the internal sound source 16 of the channel CH2. If one of the keys 2*a* between the positions P3 and P4 is pressed at a velocity between the values V1 and V3, a sound generation instruction signal having the corresponding pitch and the value of the velocity is provided to the external sound source 20*b* of the channel CH3.

In the present example as well, for each of the channels CH1 and CH3 allocated to the regions Z1 and Z3, the correspondence table generation processing shown in FIG. 5 and the sound source control processing shown in FIGS. 6 and 7, which are performed by the sound source control unit 8 shown in FIG. 4, are performed.

(7) Effect

In the electronic musical instrument 1 according to the present embodiment, when the sound source switching unit 82 is in the non-connected state, the external acoustic signal is generated by the external sound source 20 in response to the sound generation instruction signal. In this state, if a failure occurs in the external acoustic signal supplied from the external sound source 20, the sound source switching unit 82 is switched from the non-connected state to the connected state. Accordingly, the internal acoustic signal is generated by the internal sound source 16 in response to the sound generation instruction signal. In this case, an internal acoustic signal that is similar to the external acoustic signal having the desired timbre is generated by the internal sound source 16. Accordingly, it is possible to ensure continuity of the timbre of a generated sound. Accordingly, even if a failure occurs in the external acoustic signal, sound generation can be continued while suppressing a sense of incongruity felt by the user.

(8) Other Embodiments (a) In the above-described embodiment, the mode of the internal acoustic signal and the external acoustic signal is the timbre, but the present invention is not limited thereto. The mode of the internal acoustic signal and the external acoustic signal may also be one of the volume, pan position, acoustic effect, and delay time. That is, when the sound source switching signal 82 is switched from the non-connected state to the connected state, the element selected from the group including the volume, pan position, acoustic effect, and delay time of the internal acoustic signal may be set so as to be similar to the same element of the external acoustic signal.

(b) In the above-described embodiment, one correspondence table or piece of category information corresponds to each external sound source 20, but the present invention is not limited thereto. Multiple correspondence tables or pieces of category information may also correspond to each external sound source 20. In this case, one correspondence table or piece of category information that is used to set the timbre of the internal sound source 16 is selected from the multiple correspondence tables or pieces of category information. This selection may be performed manually by the user, may be performed based on a predetermined priority ranking, may be performed based on the most recent performance history, and may be performed based on a time of day of a performance.

(c) The electronic musical instrument 1 and the external sound source 20 may be connected through a USB (Universal Serial Bus) or Bluetooth (registered trademark), or communication based on another standard such as OSC (Open Sound Control) may be used.

(d) In the above-described embodiment, the sound source control unit 8 shown in FIG. 4 is realized using hardware such as the CPU 11 and software such as a sound source control program, but the constituent elements of the sound source control unit 8 may also be realized through hardware such as an electronic circuit.

(9) Correspondence Between Constituent Elements of Claims and Units of Embodiments Hereinafter, an example of a correspondence between constituent elements of the claims and the units of the embodiments will be described, but the present invention is not limited to the example. Other various elements having the configurations or functions described in the claims can be used as the constituent elements of the claims.

In the above-described embodiments, the instruction signal generation unit 81 is an example of a generation means, and the instruction signal output unit 83 is an example of an output means. The sound source switching unit 82 is an example of a switching means, the timbre setting unit 93 is an example of a setting means, and the correspondence table acquisition unit 90 is an example of an acquisition means.

The correspondence table selection unit 88 is an example of a selection means, the sound source identification unit 87 is an example of an identification means, the reception unit 89 is an example of a reception means, and the similarity degree calculation unit 92 is an example of a calculation means. The feedback acoustic signal input unit 84 is an example of an input means, the feedback acoustic signal detection unit 85 is an example of a detection means, and the sound system 17 is an example of a sound generation means.

LIST OF REFERENCE NUMERALS

Electronic musical instrument
Performance operator
2*a* Key
3, 5 Detection circuit
4 Setting operator
6 Display
7 Display circuit
8 Sound source control unit
9 RAM
10 ROM
11 CPU
12 Timer
13 Storage device
14 Communication I/F
15 External storage device
16 Internal sound source
17 Sound system
19 Bus
20, 20*a*, 20*b* External sound source
81 Instruction signal generation unit
82 Sound source switching unit
83 Instruction signal output unit
84 Feedback acoustic signal input unit
85 Feedback acoustic signal detection unit
86 Switching control unit
87 Sound source identification unit
88 Correspondence table selection unit
89 Reception unit
90 Correspondence table acquisition unit
91 Category information acquisition unit
92 Similarity degree calculation unit
93 Timbre setting unit
100 Electronic musical instrument system
200 Keyboard
C1, C2 Category information
CH1 to CH3 Channel
P1 to P4 Position
T1, T2 Correspondence table
V1 to V3 Value
Z1 to Z3 Region

The invention claimed is:

1. An electronic musical instrument comprising:

an internal sound source configured to generate an internal acoustic signal;

a generation means configured to generate a sound generation instruction signal;

an output means connected to an external sound source configured to generate an external acoustic signal, and configured to output the sound generation instruction signal to the external sound source;

a switching means configured to switch a first state in which the external acoustic signal is generated by the external sound source in response to the sound generation instruction signal to a second state in which the internal acoustic signal is generated by the internal sound source in response to the sound generation instruction signal;

a setting means configured to, when the first state is switched to the second state, set a mode of the internal acoustic signal such that the internal acoustic signal is generated with a mode similar to a mode of the external acoustic signal generated in the first state;

an input means configured to receive the external acoustic signal generated by the external sound source as a feedback acoustic signal; and a detection means configured to detect a state of input of the feedback acoustic signal to the input means, wherein the switching means is configured to switch the first state to the second state in response to a transition from a state in which input of the feedback acoustic signal to the input means is normal, to a state in which input of the feedback acoustic signal to the input means is not normal.

2. The electronic musical instrument according to claim 1, wherein the mode of the internal acoustic signal and the external acoustic signal includes a timbre.

3. The electronic musical instrument according to claim 2, wherein the mode of the internal acoustic signal and the external acoustic signal includes an attribute of a timbre.

4. The electronic musical instrument according to claim 2, further comprising an acquisition means configured to acquire correspondence information indicating the mode of the internal acoustic signal that is similar to the mode of the external acoustic signal, wherein when the first state is switched to the second state, the setting means is configured to set the mode of the internal acoustic signal based on the acquired correspondence information.

5. The electronic musical instrument according to claim 1, wherein the mode of the internal acoustic signal and the external acoustic signal includes an attribute of a timbre.

6. The electronic musical instrument according to claim 5, further comprising an acquisition means configured to acquire correspondence information indicating the mode of the internal acoustic signal that is similar to the mode of the external acoustic signal, wherein when the first state is switched to the second state, the setting means is configured to set the mode of the internal acoustic signal based on the acquired correspondence information.

7. The electronic musical instrument according to claim 1, further comprising an acquisition means configured to acquire correspondence information indicating the mode of the internal acoustic signal that is similar to the mode of the external acoustic signal, wherein when the first state is switched to the second state, the setting means is configured to set the mode of the internal acoustic signal based on the acquired correspondence information.

8. The electronic musical instrument according to claim 7, further comprising a selection means configured to select correspondence information corresponding to the external sound source in the first state among a plurality of pieces of the correspondence information prepared in correspondence with a plurality of the external sound sources, wherein the acquisition means is configured to acquire the selected correspondence information.

9. The electronic musical instrument according to claim 8, further comprising an identification means configured to identify the external sound source in the first state, wherein the selection means is configured to select the correspondence information corresponding to the identified external sound source.

10. The electronic musical instrument according to claim 9, further comprising a reception means configured to receive a selection of one of the plurality of pieces of corresponding information, wherein the selection means is configured to select the correspondence information corresponding to the external sound source selected by the reception means.

11. The electronic musical instrument according to claim 8, further comprising a reception means configured to receive a selection of one of the plurality of pieces of corresponding information, wherein the selection means is configured to select the correspondence information corresponding to the external sound source selected by the reception means.

12. The electronic musical instrument according to claim 8, wherein the external sound source has the correspondence information, and the acquisition means is configured to acquire the correspondence information from the external sound source.

13. The electronic musical instrument according to claim 7, wherein the external sound source has the correspondence information, and the acquisition means is configured to acquire the correspondence information from the external sound source.

14. The electronic musical instrument according to claim 1, further comprising a calculation means configured to calculate a degree of similarity between the mode of the external acoustic signal generated by the external sound source and the mode of the internal acoustic signal generated by the internal sound source, wherein when the first state is switched to the second state, the setting means is configured to set the mode of the internal acoustic signal based on the degree of similarity calculated by the calculation means.

15. The electronic musical instrument according to claim 1, wherein the switching means is configured to switch the second state to the first state in response to a transition from a state in which input of the feedback acoustic signal to the input means is not normal, to a state in which input of the feedback acoustic signal to the input means is normal.

16. The electronic musical instrument according to claim 1, wherein the switching means switches the first state to the second state based on a user operation.

17. An electronic musical instrument system comprising:

the electronic musical instrument according to claim 1;

one or more external sound sources connected to the electronic musical instrument; and a sound generation means configured to generate a sound based on an internal acoustic signal generated by the internal sound source of the electronic musical instrument and an external acoustic signal generated by the one or more external sound sources.

18. A method comprising:

generating a sound generation instruction signal in an electronic musical instrument including an internal sound source configured to generate an internal acoustic signal;

outputting the sound generation instruction signal from the electronic musical instrument to an external sound source configured to generate an external acoustic signal;

switching a first state in which the external acoustic signal is generated by the external sound source in response to the sound generation instruction signal to a second state in which the internal acoustic signal is generated by the internal sound source in response to the sound generation instruction signal; and automatically setting a mode of the internal acoustic signal such that the internal acoustic signal is generated with a mode similar to a mode of the external acoustic signal generated in the first state, when the first state is switched to the second state, wherein the electronic musical instrument further includes an input means configured to receive the external acoustic signal generated by the external sound source as a feedback acoustic signal; and a detection means configured to detect a state of input of the feedback acoustic signal to the input means, wherein switching includes detecting a state of input of the feedback acoustic signal to the input means, and switching the first state to the second state in response to a transition from a state in which input of the feedback acoustic signal to the input means is normal, to a state in which input of the feedback acoustic signal to the input means is not normal.

19. A non-transitory computer readable medium storing a program for causing a computer to execute:

generating a sound generation instruction signal in an electronic musical instrument including an internal sound source for generating an internal acoustic signal;

outputting the sound generation instruction signal from the electronic musical instrument to an external sound source configured to generate an external acoustic signal;

switching a first state in which the external acoustic signal is generated by the external sound source in response to the sound generation instruction signal to a second state in which the internal acoustic signal is generated by the internal sound source in response to the sound generation instruction signal; and setting a mode of the internal acoustic signal such that the internal acoustic signal is generated with a mode similar to a mode of the external acoustic signal generated in the first state, when the first state is switched to the second state, wherein the electronic musical instrument further includes an input means configured to receive the external acoustic signal generated by the external sound source as a feedback acoustic signal; and a detection means configured to detect a state of input of the feedback acoustic signal to the input means, wherein switching includes detecting a state of input of the feedback acoustic signal to the input means, and switching the first state to the second state in response to a transition from a state in which input of the feedback acoustic signal to the input means is normal, to a state in which input of the feedback acoustic signal to the input means is not normal.

* * * * *